United States Patent [19]

Jin et al.

[11] Patent Number: 4,929,421

[45] Date of Patent: May 29, 1990

[54] ALUMINUM ALLOYS AND A METHOD OF PRODUCTION

[75] Inventors: Iljoon Jin; David J. Lloyd, both of Kingston, Canada

[73] Assignee: Alcan International Limited, Montreal, Canada

[21] Appl. No.: 232,613

[22] Filed: Aug. 15, 1988

[30] Foreign Application Priority Data

Aug. 18, 1987 [CA] Canada ..... 544746

[51] Int. Cl.[5] ..... C22C 21/00

[52] U.S. Cl. ..... 420/545; 148/2; 148/11.5 A; 148/437; 148/440; 420/544; 420/553

[58] Field of Search ..... 420/545, 553, 544; 148/437, 440, 2, 11.5 A

[56] References Cited

U.S. PATENT DOCUMENTS 3,386,820 6/1968 Jagaciak ..... 75/138

FOREIGN PATENT DOCUMENTS 0136508 4/1985 European Pat. Off. .
1338974 11/1973 United Kingdom .
2146352 4/1985 United Kingdom .

*Primary Examiner*—R. Dean
*Attorney, Agent, or Firm*—Cooper & Dunham

[57] ABSTRACT

A new family of medium and high strength, thermally stable aluminum based alloys are described having the following composition: 0.4 to 1.2% by weight chromium, 0.3 to 0.8% by weight zirconium, 1.5 to 2.5% by weight manganese, 0 to 2.0% by weight magnesium and the balance essentially aluminum. These alloys can be produced on a twin-roll caster preferably at a thickness of no more than 4 mm and a casting temperature of at least 820° C.

14 Claims, 3 Drawing Sheets

ALUMINUM ALLOYS AND A METHOD OF PRODUCTION

FIELD OF THE INVENTION

Figure 1:
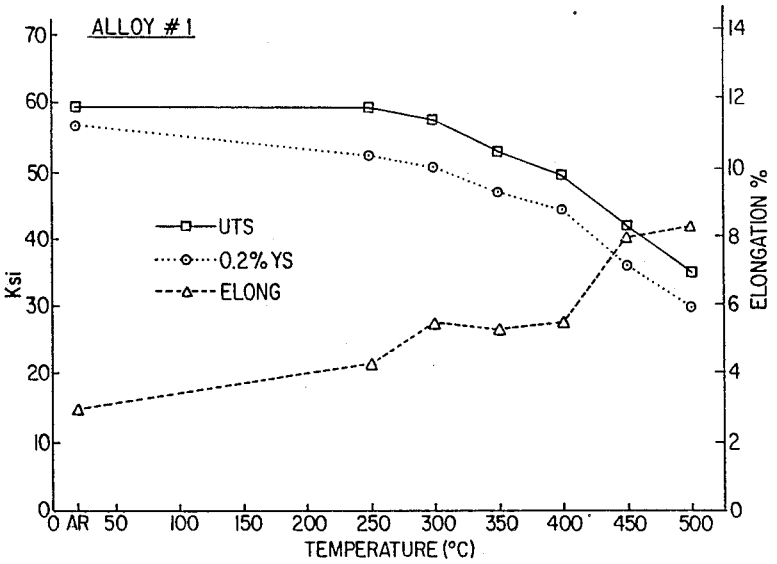

The invention relates to aluminum alloys which retain high strength after long exposure to elevated temperatures and to the casting of such alloys by strip casting techniques, e.g. twin-roll casting.

BRIEF DESCRIPTION OF THE PRIOR ART

There has been considerable interest in recent years in thermally stable aluminum alloys, i.e., alloys which do not soften after long exposure to elevated temperatures up to 350° C. To meet this need, a number of thermally stable aluminum alloys have been developed. In general, thermally stable aluminum alloys are made by the addition of transition elements which have a low diffusion coefficient and a low solid solubility in aluminum. Because of the low solubility, the alloy development involves an inherent difficulty. The alloys must be solidified from an exceptionally high melt temperature and the cooling rate during the solidification must be sufficiently high to suppress the formation of primary intermetallic particles. The primary intermetallic particles are responsible for poor mechanical properties and a reduced solute content in the aluminum matrix.

These alloys have been developed by using essentially one of two processing routes: (i) the direct ingot casting route or (ii) the powder metallurgy route.

In the direct ingot casting route, the alloy melt is poured directly into a mould. Because the alloying elements used for this purpose have a low solubility in aluminum and the cooling rate is relatively low, the alloy additions are low. Therefore, although a significant thermal stability was achieved, the strength obtained by this process is relatively low. The yield strength of these alloys is typically less than 25 ksi. A typical alloy of the above type is described in Jagaciak, Canadian Pat. No. 876,652, issued July 27, 1971 and consists essentially of 0.1 to 0.35% by weight chromium, 0.2 to 0.7% by weight zirconium, 0.3 to 1.5% by weight manganese and the balance essentially aluminum.

The powder metallurgy route involves the production of rapidly solidified alloy powder or flakes, vacuum degassing, consolidation, and extrusion. The rapid cooling rates (higher than 10000° C./s) in the powder atomizing process, splat quenching and melting spinning make it possible to extend the alloy solubility limits far beyond the limits dictated by the equilibrium phase diagram. A typical alloy of this type may contain 6 to 15% by weight iron, 1 to 10% by weight chrominum, 1 to 10% by weight zirconium, 1 to 10% by weight cerium, 1.5–10% by weight vanadium, 1–2% by weight manganese and the balance essentially aluminum. Alloys of this general type are described in EPA Publication No. 136,508, published Apr. 10, 1985. The strenght of these alloys are very high (yield strenght >60 ksi), however, the process is very complicated and expensive.

Aluminum alloys containing manganese, chromium and zirconium are described in U.K. Patent Specification No. 1,338,974, published Nov. 28, 1973. However, those alloys are designed to have a relatively low electrical conductivity, high corrosion resistance and good melt fluidity. They are not thermally stable aluminum alloys capable of being cast by strip casting techniques, such as twin-roll casting.

It is an object of the present invention to produce aluminum alloys which retain high strength after long exposure to elevated temperature and which are capable of being cast by strip casting techniques.

SUMMARY OF THE INVENTION

The present invention provides a new family of medium and high strength, thermally stable aluminum based alloys consisting essentially of the following: 0.4 to 1.2% by weight chromium; 0.3 to 0.8% by weight zirconium; 1.5 to 2.5% by weight manganese; 0 to 2.0% by weight magnesium; balance essentially aluminum.

Preferably, the alloy contains some magnesium, e.g. at least 0.01% by weight, and a preferred alloy according to the invention consists essentially of 0.5 to 1.2% by weight chromium, 0.4 to 0.8% by weight zirconium, 1.7 to 2.1% by weight manganese, 0.5 to 1.0% by weight magnesium and the balance essentially aluminum.

The above alloy has the particular advantage of being capable of being cast in a continuous strip caster, such as a twin-roll type caster. In a twin roll caster, the molten metal is solidified in the nip of a pair of heavily chilled steel rolls, which draw the molten metal out of an insulated injector nozzle in close proximity to the rolls, the cast material being in the form of a strip or slab e.g. in a thickness range of up to 25 mm and being typically cast at a speed of 60 to 200 cm/min. The metal is essentially fully solidified when it passes the centre line of the caster rolls. It is subjected to heavy compression and some plastic deformation as it passes through the gap between the rolls, with the consequence that its surfaces are in excellent heat exchange contact with the caster rolls, which are intensively water cooled.

When the thermally stable alloys of this invention are to be cast at a thin gauge (less than 15 mm) on a roll caster, the cooling rate itself is not a problem. The cooling rate on a roll caster is in the range of 500°–3000° C./S, and this is sufficiently high to suppress the nucleation of intermetallic particles. The problem arises mainly from the fact that roll casters can be operated only at speeds between two critical casting speeds, referred to as the "lower critical speed" and the "upper critical speed". The lower critical speed is a speed below which casting is impossible because longitudinal heat flow causes metal freezing in the casting tip. The upper critical speed is a speed above which the heat transfer mechanism in the roll bite breaks down and hence the alloy melt does not fully solidify. In principle, both the lower and upper critical speeds vary depending on the melt temperature, the strip gauge and the alloy composition. However, the lower speed is relatively insensitive to a change in casting variables, and its value for the present alloys is about 30 cm/min. The upper speed varies very sensitively depending on the values of the melt temperature, the strip gauge and the alloy composition. The melt temperature of the alloys required to suppress the primary formation is 820° C. or higher and preferably at least 850° C. If this high temperature melt is to be cast at a typical roll casting gauge of 6 mm, the upper critical speed falls down to 25 cm/min or less and the alloy cannot be cast. Because of the above requirements, it has not been possible heretofore to produce satisfactory thermally stable aluminum alloys by twin roll casters.

To produce good thermal stability according to the present invention, the alloy must be cast at a temperature higher than the equilibrium liquidus temperature. A casting temperature of at least 820° C. is required with a temperature of at least 850° C. being preferred. The casting speed is preferably at least 30 cm/min and the cast material preferably has a thickness of no more than 4 mm.

It has been found that when the as-cast alloy strip is heat treated at a temperature in the range of 360°–400° C. for about 2 to 60 hours and cold-rolled 50–75%, a good combination of mechanical properties are obtained. Typical property ranges are:

Yield Strength: 30–55 ksi

Ultimate Yield Strength: 35–60 ksi

Elongation: 2–10%.

The above properties have shown a retention of more than 80% after 2 hours exposure at elevated temperatures up to 350° C.

With the alloys of the present invention, it has been found that when the cast material had thicknesses substantially greater than 4 mm, it is not possible to produce a cast material which is free of primary intermetallic particles because the upper critical speed is too low. Particularly good results are obtained with a thickness of about 3 mm and a casting speed of at least 38 cm/min.

It is, of course, known that magnesium may be used to provide strengthening in aluminum alloys and has been used in twin-roll casting. However, the conventional magnesium-containing alloys soften very easily at temperatures above 200° C. because of high diffusivity and are diffcult to cast on a twin roll caster. It has surprisingly been found according to the present invention that when magnesium is used in combination with chromium, zirconium and manganese, a combination of high strength and good thermal stability can be obtained even in material produced by means of a twin-roll caster.

In the accompanying drawings.

Figure 2:
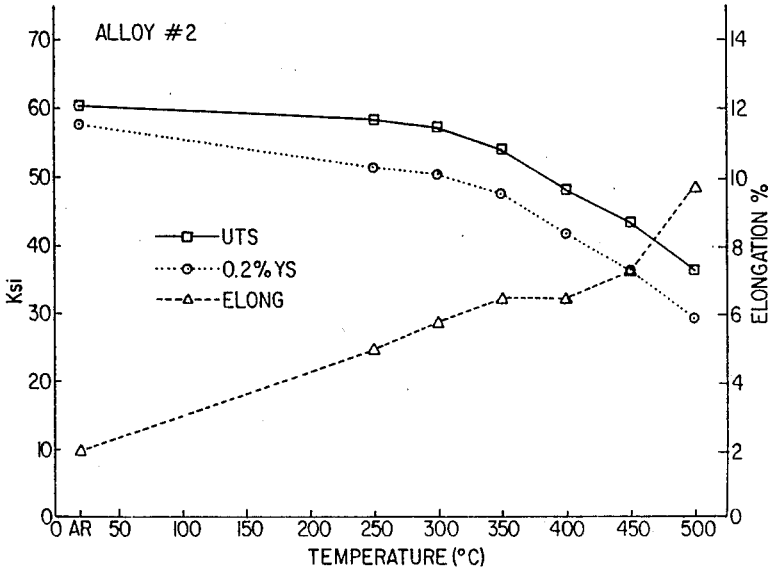
Figure 3:
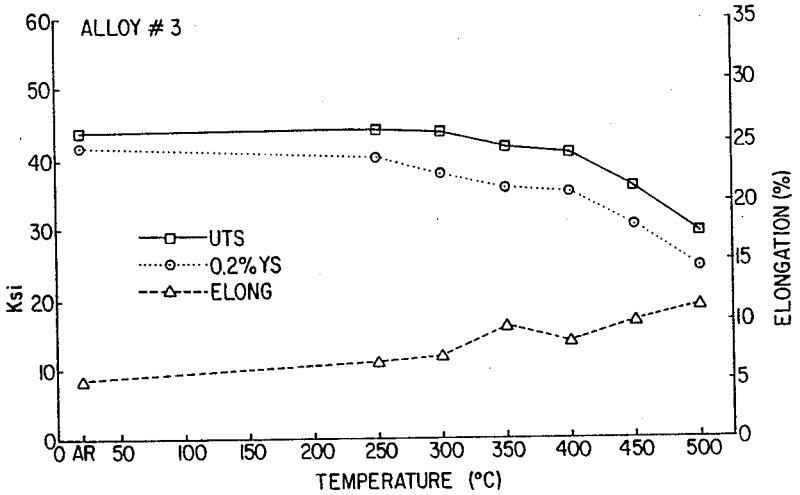
Figure 4:
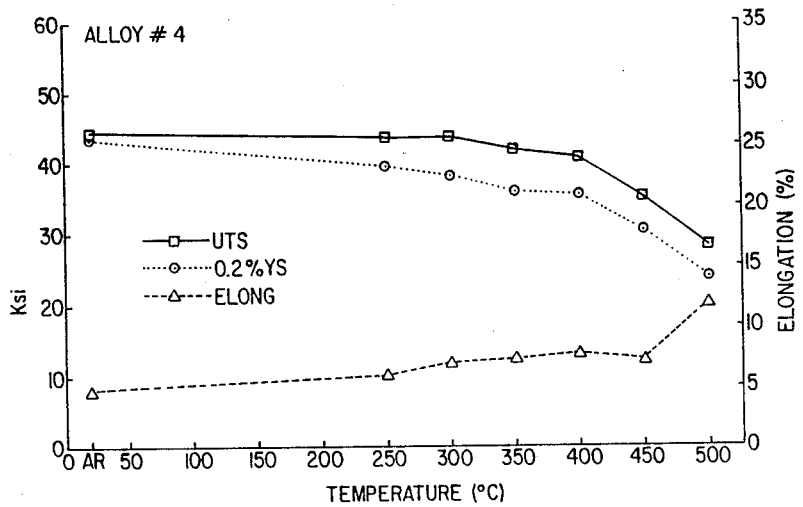
Figure 5:
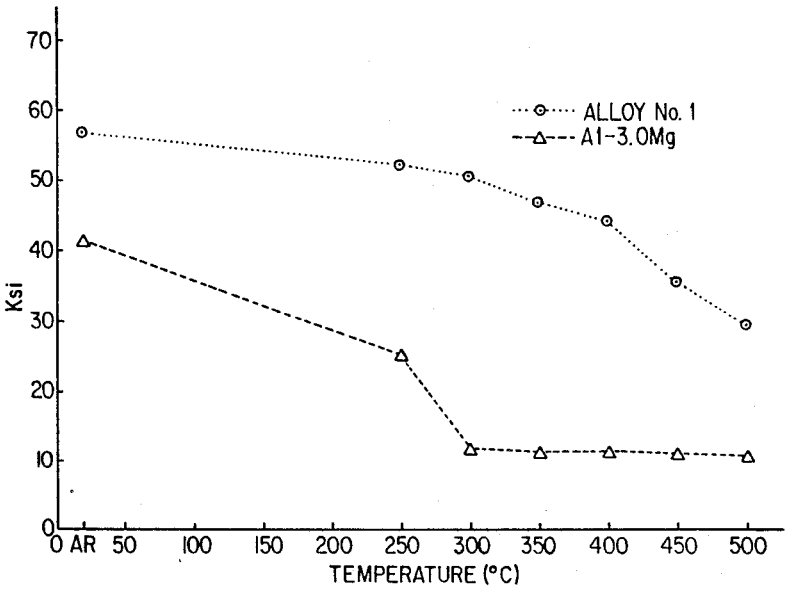

FIG. 1 is a plot of mechanical properties vs. annealing temperature for one alloy of the invention, FIG. 2 is a plot of mechanical properties vs. annealing temperature for a second alloy of the invention, FIG. 3 is a plot of mechanical properties vs. annealing temperature for a third alloy of the invention, FIG. 4 is a plot of mechanical properties vs. annealing temperature for a fourth alloy of the invention, and FIG. 5 is plots of yield strengths vs. annealing temperatures for a prior alloy and an alloy of the invention.

The following examples are presented to provide a more complete understanding of the invention. The specific techniques, conditions, materials, proportions and reported data set forth to illustrate the principles and practice of the invention are examplary and should not be construed as limiting the scope of the invention.

Example 1

Two alloys were tested having the compositions shown in Table 1 below.

TABLE 1

| Alloy No. | Alloy Compositions (wt. %) Fe | Si | Mg | Mn | Cr | Zr | Ti |
|---|---|---|---|---|---|---|---|
| 1 | 0.23 | 0.08 | 0.53 | 1.82 | 0.88 | 0.50 | 0.004 |
| 2 | 0.15 | 0.05 | 0.86 | 1.87 | 0.63 | 0.40 | 0.003 |

The above alloys were melted in a gas fired graphite crucible. The molten metal was fluxed with a 90% Ar+10% $Cl_2$ gas mixture and cast on a 305 mm diameter twin roll caster. The casting temperature was 860° C. and the strip thickness was 3.2 mm. The strip was annealed at 375° C. for 48 hours and then cold rolled to 0.8 mm (75% reduction). The rolled strip samples were annealed at various temperatures for 2 hours and their mechanical properties were measured. A plot of ultimate tensile strength (UTS), yield strength (YS) and elongate vs. annealing temperature is shown in FIGS. 1 and 2 for Alloy Nos. 1 and 2 respectively. These show that the ultimate tensile strength is higher than 55 ksi, the yield strength higher than 50 ksi and the elongation greater than 2%. The alloy did not soften significantly at temperatures up 350° C.

Example 2

Two additional alloys were tested having the compositions shown in Table 2 below.

TABLE 2

| Alloy No. | Alloy Compositions (wt. %) Fe | Si | Mg | Mn | Cr | Zr | Ti |
|---|---|---|---|---|---|---|---|
| 3 | 0.12 | 0.045 | 0.016 | 2.26 | 0.77 | 0.45 | 0.009 |
| 4 | 0.22 | 0.050 | 0.017 | 2.28 | 0.47 | 0.49 | 0.007 |

The above alloys were cast in the same manner as the alloys of Example 1 and the results are shown in FIGS. 3 and 4 for Alloy Nos. 3 and 4 respectively. These show that the ultimate tensile strength is higher than 40 ksi, the yield strength is higher than 35 ksi and the elongation is greater than 5%. The alloy did not soften significantly up to 400° C.

A comparison between the alloy softening curves (yield strengths) of an alloy according to the present invention and a prior art Al-3.0% Mg alloy is given in FIG. 5. This clearly shows that the present alloy has good thermal stability whereas the Al-Mg alloy completely softens at temperatures above 300° C.

We claim:

1. An aluminum-base alloy consisting essentially of the following: 0.4 to 1.2% by weight chromium; 0.3 to 0.8% by weight zirconium; 1.5 to 2.5% by weight manganese; 0.01 to 2.0% by weight magnesium; balance essentially aluminum.

2. An alloy according to claim 1 consisting essentially of the following: 0.5 to 1.2% by weight chromium; 0.4 to 0.8% by weight zirconium; 1.7 to 2.1% by weight manganese; 0.5 to 1.0% by weight magnesium and the balance essentially aluminum.

3. An alloy according to claim 1 in the form of a cast strip.

4. An alloy according to claim 1 in the form of a cast strip having a thickness of no more than 4 mm.

5. An alloy according to claim 1 in the form of a strip having a thickness of no more than 4 mm which has been heat treated at a temperature in the range of 360°–400° C. and cold-rolled 50–75%.

6. An alloy according to claim 1 which is thermally stable up to 350° C.

7. An alloy according to claim 1 having the following properties:

Yield Strength: 30–55 ksi

Ultimate Yield Strength: 35–60 ksi

Elongation: 2–10%.

8. A method of casting a thermally stable aluminum alloy by means of a twin-roll caster in which the molten metal is solidified in the nip of a pair of chilled rolls which draw molten metal out from a nozzle adjacent the rolls, characterized in that the alloy consists essentially of the following: 0.4 to 1.2% by weight chromium; 0.3 to 0.8% by weight zirconium; 1.5 to 2.5% by weight manganese; 0 to 2.0% by weight magnesium; balance essentially aluminum.

9. A method according to claim 8 wherein the alloy contains at least 0.01% by weight magnesium.

10. A method according to claim 9 wherein the alloy consists essentially of the following: 0.5 to 1.2% by weight chromium; 0.4 to 0.8% by weight zirconium; 1.7 to 2.1% by weight manganese; 0.5 to 1.0% by weight magnesium and the balance essentially aluminum.

11. A method according to claim 8 wherein the cast strip is formed to a thickness of no more than 4 mm.

12. A method according to claim 8 wherein the molten metal has a temperature of at least 820° C.

13. A method according to claim 8 wherein the casting is formed at a speed of at least 30 cm/min.

14. A method according to claim 8 wherein the cast strip is heat treated at a temperature in the range of 360°–400° C. for about 2 to 60 hours and cold-rolled 50–75%.

* * * * *